US009992591B2

(12) United States Patent
Kelloniemi et al.

(10) Patent No.: US 9,992,591 B2
(45) Date of Patent: Jun. 5, 2018

(54) ARRANGING AN AUDIO SIGNAL BASED ON THE NUMBER OF LOUDSPEAKERS

(71) Applicant: Nokia Corporation, Espoo (FI)

(72) Inventors: Antti Pekka Kelloniemi, Helsinki (FI); Jouni Kaukovuori, Vantaa (FI); Miikka Tikander, Helsinki (FI)

(73) Assignee: Nokia Technologies Oy, Espoo (FI)

( * ) Notice: Subject to any disclaimer, the term of this patent is extended or adjusted under 35 U.S.C. 154(b) by 0 days. days.

(21) Appl. No.: 14/872,393

(22) Filed: Oct. 1, 2015

(65) Prior Publication Data

US 2016/0029136 A1 Jan. 28, 2016

Related U.S. Application Data

(63) Continuation of application No. 13/704,284, filed as application No. PCT/IB2010/052836 on Jun. 22, 2010, now Pat. No. 9,161,129.

(51) Int. Cl.

| | |
|---|---|
| ***H04R 27/00*** | (2006.01) |
| ***H04R 3/12*** | (2006.01) |
| *H04S 7/00* | (2006.01) |

(52) U.S. Cl.

CPC ..... *H04R 27/00* (2013.01); *H04R 3/12* (2013.01); *H04R 2227/003* (2013.01); *H04R 2420/07* (2013.01); *H04S 7/30* (2013.01)

(58) Field of Classification Search

None

See application file for complete search history.

(56) References Cited

U.S. PATENT DOCUMENTS

| | | | | |
|---|---|---|---|---|
| 7,590,233 | B2 * | 9/2009 | Chiloyan | H04R 1/1033 379/430 |
| 7,864,962 | B2 * | 1/2011 | Henson | H04R 5/02 381/11 |
| 2003/0073460 | A1 | 4/2003 | Van Pelt et al. | |
| 2005/0190928 | A1 * | 9/2005 | Noto | H04R 3/12 381/77 |
| 2007/0087686 | A1 | 4/2007 | Holm et al. | |
| 2007/0160225 | A1 * | 7/2007 | Seydoux | H04W 8/005 381/79 |
| 2007/0223725 | A1 | 9/2007 | Neumann et al. | |
| 2008/0070516 | A1 | 3/2008 | Lee et al. | |

(Continued)

FOREIGN PATENT DOCUMENTS

| | | |
|---|---|---|
| EP | 1 615 464 A1 | 1/2006 |
| EP | 1 670 283 A1 | 6/2006 |

OTHER PUBLICATIONS

Onkyo *AV Receiver TX-LR552 Instruction Manual* dated Aug. 5, 2004.

*Primary Examiner* — Paul Huber

(74) *Attorney, Agent, or Firm* — Harrington & Smith

(57) ABSTRACT

An apparatus including: a router configured to route a first audio signal to a local loudspeaker apparatus; and a switch configured to route at least one further audio signal, wherein in a first mode of operation the switch is configured to route the at least one further audio signal to at least one remote loudspeaker apparatus dependent on determining the presence of at least one remote loudspeaker apparatus, and in a second mode of operation the switch is configured to route the at least one further audio signal to the local loudspeaker apparatus.

24 Claims, 4 Drawing Sheets

(56) References Cited

U.S. PATENT DOCUMENTS

| | | | | |
|---|---|---|---|---|
| 2008/0205664 | A1 | 8/2008 | Kim et al. | |
| 2009/0175456 | A1* | 7/2009 | Johnson | H04R 5/04 381/1 |
| 2009/0279722 | A1* | 11/2009 | Lin | H04R 5/04 381/311 |
| 2010/0020998 | A1* | 1/2010 | Brown | H04R 1/1041 381/380 |

* cited by examiner

ARRANGING AN AUDIO SIGNAL BASED ON THE NUMBER OF LOUDSPEAKERS

CROSS REFERENCE TO RELATED APPLICATIONS

This patent application is a continuation application of copending U.S. patent application Ser. No. 13/704,284, filed on Dec. 14, 2012, which is a national stage entry of PCT/IB2010/052836, filed on Jun. 22, 2010, the disclosures of both applications being incorporated by reference herein in their entireties.

The present invention relates to an apparatus and method for sound generating devices and apparatus. The invention further relates to, but is not limited to, an apparatus for use with sound generating devices for arranging an audio signal based upon a number of loudspeaker modules.

Sound generating devices such as mobile or cellular handsets or other portable devices such as gaming devices, personal computers or music players are known to include a suitable sound generating system comprising suitable software algorithms, electrical circuitries and mechanical arrangements. In case of a mobile handset, an integrated loudspeaker module can for example reproduce a downlink or received audio signal or reproduce any compatible format audio signal. In recent years, sound generating devices have been designed to assist different use cases such as music playback, ringtone playback, FM radio playback etc. In addition, such devices comprise further connectors for providing connectivity to external interfaces such as audio connectors and/or USB connectors. Wireless connectors, such as Bluetooth are also known and can be used. It is therefore possible to arrange a playback functionality using these external interfaces. For example, an audio file can be played from an external loudspeaker system or a headset that may comprise one or more speaker module enabling sound reproduction.

Apparatus such as an external speaker system may comprise at least one speaker module for example an electro acoustic transducer or a suitably designed sound reproduction module in order to reproduce an audio signal to the exterior. It is understood that an audio signal is converted into an acoustic signal by the external loudspeaker system. The acoustic signal may be required to meet certain criteria including performance and quality of the sound generating device although such external loudspeaker system may be independently designed and is possibly used with a number of different sound generating devices. The acoustic signal may be controlled to provide a particular standard of sound quality to a user and therefore some dedicated software algorithms may apply to the audio signal to adjust the acoustic signal. In addition, it may be that the sound generating device may assign some pre-determined software settings such as a 'flat' equaliser response and/or optimised gain levels as soon as the external loudspeaker system is interfaced. A number of different alternatives may be considered by the sound generating device and/or the external loudspeaker system so that a detection mechanism could be provided somewhere in the playback chain when the external loudspeaker system is interfaced with the sound generating device. As a result, some improved and/or controlled software settings are suitably applied to the audio signal when the external loudspeaker system is detected. However, a problem arises for example when the audio signal is a multi-channel audio signal and when the external loudspeaker system comprises a monophonic loudspeaker module. In such circumstances it is understood that the user listening to a stereo audio signal would have a diminished listening experience.

Similarly the external loudspeaker system may comprise more than one loudspeaker module but in some circumstances only one of the loudspeaker modules is operational due to various different reasons. For example one of the loudspeaker module/s may be disconnected, or unpowered, or possibly damaged. In this circumstance, the monophonic loudspeaker module would still generate the acoustic signal by converting the associated audio signal channel of the multi-channel audio signal provided by the sound generating device. In case of a stereo playback, the monophonic loudspeaker module of the external loudspeaker system would convert only one channel of the multi-channel audio signal into an acoustic signal which would as described above diminish the listening experience for the user listening to a stereo audio signal.

It is useful to therefore ensure that such external loudspeaker systems are suitably configured to reproduce the audio signal provided by the sound generating systems. It is understood that the audio signal may be a single channel monophonic signal or a multi-channel audio signal.

There is provided according to a first aspect of the invention a method comprising: routing a first audio signal to a local loudspeaker apparatus; routing at least one further audio signal, wherein in a first mode of operation routing comprises routing the at least one further audio signal to at least one remote loudspeaker apparatus dependent on determining the presence of at least one remote loudspeaker apparatus; and in a second mode of operation routing comprises routing the at least one further audio signal to the local loudspeaker apparatus.

The method may further comprise combining the first audio signal and the at least one further audio signal in the local loudspeaker apparatus in the second mode of operation.

The method may further comprise filtering the first audio signal and the at least one further audio signal in the local loudspeaker apparatus in the second mode of operation.

The method may further comprise amplifying the first audio signal and the at least one further audio signal in the local loudspeaker apparatus in the second mode of operation.

The method may further comprise; determining the presence of at least one remote loudspeaker apparatus; and controlling routing at least one further audio signal to operate in the second mode on determining the presence of the at least one remote loudspeaker apparatus.

Determining the presence of at least one remote loudspeaker apparatus may comprises at least one of: determining a physical audio signal connection between the local loudspeaker apparatus and the remote loudspeaker apparatus; and determining a wireless audio signal connection between the local loudspeaker apparatus and the remote loudspeaker apparatus.

Determining a wireless audio signal connection may comprise at least one of: determining an infra red data connection; determining a wi-fi data connection; determining a wireless local area network connection; determining a wireless personal area network connection; determining a Bluetooth connection; and determining a cellular data connection.

The method may further comprise: routing a first audio signal from the at least one audio signal to the remote loudspeaker apparatus; routing at least one audio signal from the at least one further audio signal, wherein in a first further mode of operation routing at least one audio signal from the at least one further audio signal comprises routing the at least one audio signal from the at least one further audio signal to at least one further remote loudspeaker apparatus dependent on determining the presence of at least one further remote loudspeaker apparatus; and in a second further mode of operation routing at least one audio signal from the at least one further audio signal comprises routing at least one audio signal from the at least one further audio signal the to the remote loudspeaker apparatus.

In the first mode of operation routing may comprise: determining at least two remote loudspeaker apparatus; routing at least one of the at least one further audio signal to a first of the at least two remote loudspeaker apparatus; and routing at least one further audio signal from the at least one further audio signal to a second of the at least two remote loudspeaker apparatus.

The method may further comprise receiving the first audio signal and the at least one further audio signal from a user apparatus.

According to a second aspect of the invention there is provided an apparatus comprising at least one processor and at least one memory including computer code, the at least one memory and the computer code configured to with the at least one processor cause the apparatus to at least perform: routing a first audio signal to a local loudspeaker apparatus; routing at least one further audio signal, wherein in a first mode of operation routing comprises routing the at least one further audio signal to at least one remote loudspeaker apparatus dependent on determining the presence of at least one remote loudspeaker apparatus; and in a second mode of operation routing comprises routing the at least one further audio signal to the local loudspeaker apparatus.

The apparatus may be further configured to perform combining the first audio signal and the at least one further audio signal in the local loudspeaker apparatus in the second mode of operation.

The apparatus may be further configured to perform filtering the first audio signal and the at least one further audio signal in the local loudspeaker apparatus in the second mode of operation.

The apparatus may be further configured to perform amplifying the first audio signal and the at least one further audio signal in the local loudspeaker apparatus in the second mode of operation.

The apparatus may be further configured to perform: determining the presence of at least one remote loudspeaker apparatus; and controlling routing at least one further audio signal to operate in the second mode on determining the presence of the at least one remote loudspeaker apparatus.

Determining the presence of at least one remote loudspeaker apparatus may be further configured to cause the apparatus to perform: determining a physical audio signal connection between the local loudspeaker apparatus and the remote loudspeaker apparatus; and determining a wireless audio signal connection between the local loudspeaker apparatus and the remote loudspeaker apparatus.

Determining the wireless audio signal connection may further cause the apparatus to perform: determining an infra red data connection; determining a wi-fi data connection; determining a wireless local area network connection; determining a wireless personal area network connection; determining a Bluetooth connection; and determining a cellular data connection.

The apparatus may be further configured to perform: routing a first audio signal from the at least one audio signal to the remote loudspeaker apparatus; and routing at least one audio signal from the at least one further audio signal, wherein in a first further mode of operation routing at least one audio signal from the at least one further audio signal comprises routing the at least one audio signal from the at least one further audio signal to at least one further remote loudspeaker apparatus dependent on determining the presence of at least one further remote loudspeaker apparatus; and in a second further mode of operation routing at least one audio signal from the at least one further audio signal comprises routing at least one audio signal from the at least one further audio signal the to the remote loudspeaker apparatus.

Routing in the first mode of operation may cause the apparatus to perform: determining at least two remote loudspeaker apparatus; routing at least one of the at least one further audio signal to a first of the at least two remote loudspeaker apparatus; and routing at least one further audio signal from the at least one further audio signal to a second of the at least two remote loudspeaker apparatus.

The apparatus may be further configured to perform receiving the first audio signal and the at least one further audio signal from a user apparatus.

According to a third aspect of the invention there is provided an apparatus comprising: a router configured to route a first audio signal to a local loudspeaker apparatus; and a switch configured to route at least one further audio signal, wherein in a first mode of operation the switch is configured to route the at least one further audio signal to at least one remote loudspeaker apparatus dependent on determining the presence of at least one remote loudspeaker apparatus, and in a second mode of operation the switch is configured to route the at least one further audio signal to the local loudspeaker apparatus.

The apparatus may further comprise a combiner configured in the second mode of operation to perform combine the first audio signal and the at least one further audio signal in the local loudspeaker apparatus.

The apparatus may further comprise a filter configured in the second mode of operation to filter the first audio signal and the at least one further audio signal in the local loudspeaker apparatus.

The apparatus may further comprise an amplifier configured in the second mode of operation to amplify the first audio signal and the at least one further audio signal in the local loudspeaker apparatus.

The apparatus may further comprise a controller configured to determine the presence of at least one remote loudspeaker apparatus; and control the switch to operate in the second mode on determining the presence of the at least one remote loudspeaker apparatus.

The controller may further comprise a physical connection determiner configured to determine a physical audio signal connection between the local loudspeaker apparatus and the remote loudspeaker apparatus.

The controller may further comprise a wireless connection determiner configured to determine a wireless audio signal connection between the local loudspeaker apparatus and the remote loudspeaker apparatus.

The wireless connection determiner may comprise at least one of: an infra red data connection determiner; a wi-fi data connection determiner; a wireless local area network connection determiner; a wireless personal area network connection determiner; a Bluetooth connection determiner; and a cellular data connection determiner.

The apparatus may further comprise a further router configured to route a first audio signal from the at least one audio signal to the remote loudspeaker apparatus; and a further switch configured to route in a first further mode of operation at least one audio signal from the at least one further audio signal to at least one further remote loudspeaker apparatus dependent on determining the presence of at least one further remote loudspeaker apparatus; and in a second further mode of operation route at least one audio signal from the at least one further audio signal comprises routing at least one audio signal from the at least one further audio signal the to the remote loudspeaker apparatus.

The controller may determine at least two remote loudspeaker apparatus

The switch may be configured to route at least one of the at least one further audio signal to a first of the at least two remote loudspeaker apparatus; and route at least one further audio signal from the at least one further audio signal to a second of the at least two remote loudspeaker apparatus.

The apparatus may comprise an input configured to receive the first audio signal and the at least one further audio signal from a user apparatus.

A system comprising at least two apparatus as described above wherein the first apparatus local loudspeaker apparatus is the first apparatus loudspeaker apparatus and the first apparatus remote loudspeaker apparatus is the second apparatus loudspeaker apparatus.

According to a fourth aspect of the invention there is provided a computer-readable medium encoded with instructions that, when executed by a computer, perform: routing a first audio signal to a local loudspeaker apparatus; routing at least one further audio signal, wherein in a first mode of operation routing comprises routing the at least one further audio signal to at least one remote loudspeaker apparatus dependent on determining the presence of at least one remote loudspeaker apparatus; and in a second mode of operation routing comprises routing the at least one further audio signal to the local loudspeaker apparatus.

According to a fifth aspect of the invention there is provided an apparatus comprising routing means configured to route a first audio signal to a local loudspeaker apparatus; and switching means configured to route at least one further audio signal, wherein in a first mode of operation the switching means is configured to route the at least one further audio signal to at least one remote loudspeaker apparatus dependent on determining the presence of at least one remote loudspeaker apparatus, and in a second mode of operation the switching means is configured to route the at least one further audio signal to the local loudspeaker apparatus.

For better understanding of the present invention, reference will now be made by way of example to the accompanying drawings in which:

FIG. 1 schematically illustrates an apparatus according to some embodiments;

Figure 1:
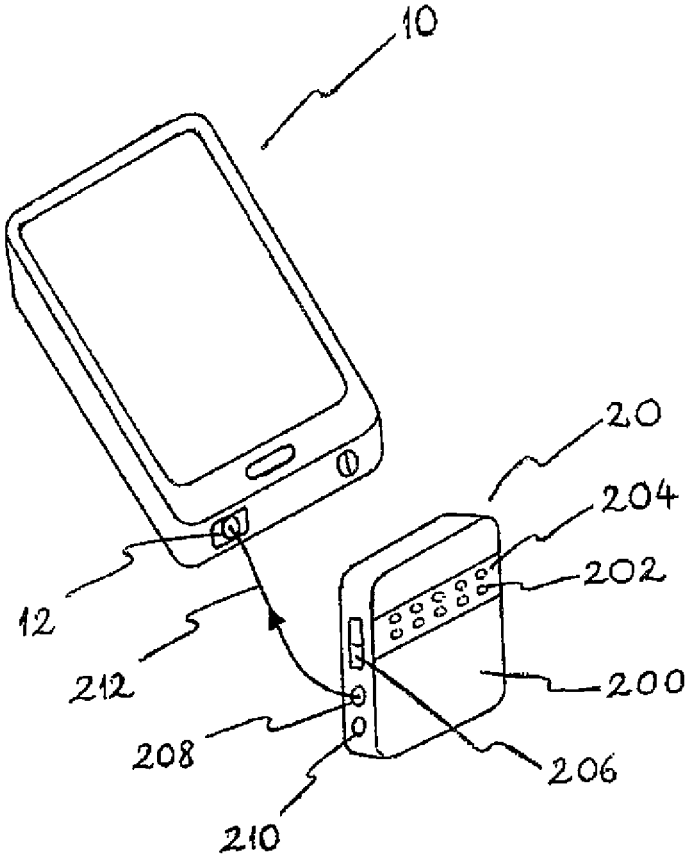

The following describes in further detail suitable apparatus and possible mechanisms for configuring external loudspeaker systems for the reproduction of audio signals such as those provided by sound generating devices for playback operations. In this regard reference is first made to FIG. 1 which shows an illustration of an example apparatus in conjunction with an example sound generating device in accordance with an embodiment of the present invention. The sound generating device as shown in FIG. 1 is a user equipment 10 in the form of a mobile phone. However it would be appreciated that the user equipment 10 in some embodiments can in some embodiments comprise any apparatus configured to provide audio playback operations which can be for example but not exclusively an audio player (such as a mp3 player), a media player (such as a mp4 player), a portable computer (for example a laptop/netbook), a portable DVD/Blu-ray player, a gaming device, or a personal communication device.

FIG. 1 also shows a schematic 3 dimensional view of an external loudspeaker apparatus 20 operating as a part of an external loudspeaker system according to some embodiments.

The external loudspeaker apparatus 20 in some embodiments comprises an outer cover 200 which houses any internal components. The outer cover 200 in some embodiments comprises at least one sound aperture 202. In these embodiments the sound aperture 202 can be included as a separate surface 204 from the outer cover 200 or in some other embodiments can be formed as part of the outer cover 200.

When the external loudspeaker apparatus 20 is interfaced with the mobile phone 10 and suitably positioned by a user, sound is generated in playback operations by the external loudspeaker apparatus 20 wherein at least one loudspeaker module (not shown but located within the external loudspeaker apparatus 20) reproduces the audio signal. The loudspeaker module can be any suitable electro-acoustical transducer, such as for example a moving-coil transducer, a moving-magnet transducer, an electrostatic transducer, and a piezo-electric transducer.

The external loudspeaker apparatus 20 in some embodiments further comprises a volume control button 206 with which the user can control the volume of an output of the loudspeaker module (not shown). In some embodiments, it may be possible that the volume control is automated which is assisted by a sensor data or a microphone output signal such as those provided for monitoring environmental sounds or noise levels.

The external loudspeaker apparatus 20 is used for at least handsfree operations such as music playback, ringtone alerts, handsfree speech and/or video call or audio reproduction of audio/visual playback. In some embodiments the external loudspeaker apparatus 20 can further comprise at least one microphone module (not shown).

In some embodiments the external loudspeaker apparatus 20 can comprise at least one microphone inlet (not shown) configured to be connected to the at least one microphone module and configured to capture acoustic waves such that the microphone module can output representations of the acoustic waves as electrical signals. These electrical signals can in some embodiments be processed and/or transmitted to other devices and/or stored for later playback and/or used as a trigger for controlling different mechanisms such as those used for noise cancellers.

The sound aperture 202 in some embodiments effectively couples the acoustic output of the loudspeaker module (not shown) to the exterior of the external loudspeaker apparatus 20. In some embodiments, the sound aperture 202 can comprise a suitable mesh structure or grill which may take various forms, shapes or materials and which may be designed in relation to the loudspeaker module to produce a desired frequency response when operated in 'free air'. In some embodiments, the loudspeaker module acoustically and substantially can be transparent, for example, the sound aperture 202 can be large enough and may be substantially equivalent to the diaphragm surface (not shown) of the loudspeaker module. The sound aperture 202 furthermore in some embodiments can be structured as an array of individual small openings or may be a single cross sectional area. The sound aperture 202 in some embodiments can be rectangular, cylindrical or any suitable shape.

The external loudspeaker apparatus 20 in some embodiments further can provide at least one connector socket 208 enabling the user to interface the external loudspeaker apparatus 20 to the mobile phone 10. In this example embodiment as shown in FIG. 1, said interface is provided by an interface cable 212 which connects the connector socket 208 to the mobile phone 10 using an audio connector socket 12 located on the mobile phone 10. It is understood that the interface cable 212 is configured to be detached from both devices. In other words the interface cable 212 is in these embodiments terminated at either end by a plug suitable for providing a physical connection with the mobile phone 10 audio connector socket 12 and the external loudspeaker apparatus 20 at least one connector socket 208.

In some embodiments the interface cable 212 can be configured to be permanently connected to the external loudspeaker apparatus 20 at least one connector socket 208 and be terminated at the other end with a plug suitable for providing a physical connection with the mobile phone 10 audio connector socket 12. In other words the interface cable 212 can effectively be seen as an extension of the connector socket 208. For example in some embodiments an audio connector socket 208 is suitably positioned in the external loudspeaker system 20. In some embodiments, the connector socket 208 can be substantially hidden behind a suitably arranged door or lid. The connector socket 208 can be any suitable socket configuration suitable for connection with an audio connector, an audio plug or audio/visual (A/V) connector plug. The connector socket 208 in some embodiments therefore provides a releasable connection with audio or NV plugs (not shown). It is understood that the connector socket 208 can in some embodiments be a recognised standard audio and/or audio-video connector such as 3.5 mm and/or 2.5 mm connector socket. In some embodiments, the external loudspeaker apparatus 20 connector socket 208 can comprise a universal serial bus (USB) interface socket. The USB connector in some embodiments can be at least one of a standard USB, a micro USB, or a mini USB sized connection. The USB standard provides specifications for a host, a device and the cabling which links them. Amongst other requirements of the standard, a USB host may be capable of detecting the speed of those devices with which it is communicating. In some embodiments, the USB connector provides releasable connection with audio or A/V USB plugs (not shown). The external loudspeaker apparatus 20 can in such embodiments comprise a suitably integrated USB control function which may be controlled by a processor.

The connector socket 208 in these embodiments can be suitably arranged to receive and/or provide a USB connector plug (not shown) to interface the external loudspeaker apparatus 20 to the mobile phone 10. The external loudspeaker apparatus 20 in some embodiments can further require a power supply operation, for example in some embodiments the loudspeaker module is driven using an amplified signal. In these embodiments the external loudspeaker apparatus 20 can further comprise a charging connector (not shown) suitable for providing power for the external loudspeaker apparatus 20. The charging connector can be of various sizes, shapes and combinations or in some embodiments can be visually or substantially hidden. In some embodiments, the charging operation can be provided using a wireless connection.

In some embodiments, the connector socket 208 can be configured to provide the power as well as the audio signal for playback operations. The connector socket 208 in some embodiments can therefore be described as being a socket providing at least a suitable compatible interface to sound generating devices such as the mobile phone 10.

The external loudspeaker system 20 in some further embodiments can comprise at least one second or further connector socket 210. The at least one further connector socket, of which one is shown in FIG. 1, is configured to be suitable for receiving at least one further interfaces from other devices. For example the at least one further connector socket 210 can in some embodiments be suitable for receiving at least one further interface to connect the external loudspeaker apparatus 20 to a further sound generating device and/or a further external loudspeaker apparatus.

For example in the embodiments shown in FIG. 1, where the mobile phone has a monophonic loudspeaker module the connection of the external loudspeaker apparatus 20 to the mobile phone 10 via the interface cable 212 can provide a multi-channel audio signal, such as a stereo audio signal. In such embodiments a first channel of a multi-channel audio signal can be passed to the external loudspeaker apparatus 20 to be output on the external loudspeaker apparatus 20 and a further channel of the multi-channel audio signal is output by an integrated handsfree loudspeaker module within the mobile phone 10. In some further embodiments the multi-channel audio signal is passed to the external loudspeaker apparatus 20 wherein the multi-channel audio signal is downmixed to a monophonic format to be output by the external loudspeaker apparatus 20.

It should be understood that the position of connectors and apertures described in the example embodiments are examples only and alternative embodiments can have different arrangements and configurations of the above connections, outlets and inlets.

For example the external loudspeaker apparatus can in some embodiments be interfaced with the mobile phone using a wireless connection. All modules and numerals as seen in the supportive figures of embodiments described above and below can also apply for a wireless interface and/or wireless connection. Thus a wireless interface and/or wireless connection can in these embodiments be substituted for the term connection or cable. The external loudspeaker apparatus can therefore in some embodiments be used for at least handsfree operations such as music playback, ringtone alerts, handsfree speech and/or video call or audio reproduction of audio/visual playback. The audio signal can, as hereafter described, be transmitted to the external loudspeaker system using a wireless connection such as a standard Bluetooth (BT) connection (and in some embodiments can be part of a non-cellular short range wireless connection such as a wireless personal area network or WPAN). However it would be appreciated then in some embodiments other wireless communication protocols can be used, for example the protocols called Wi-Fi (or 802.11 derived communication systems which can in some embodiments be configured as part of a wireless local area network or WLAN). The audio signal can in some embodiments be a multi-channel audio signal such as a stereo signal which is summed when only one external loudspeaker system is wirelessly interfaced.

Figure 2:
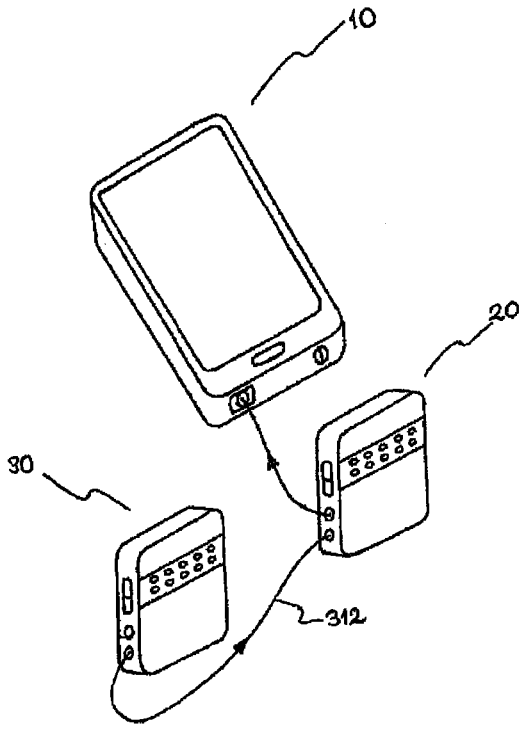
FIG. 2 shows schematically the apparatus shown in FIG. 1 in further detail.

In FIG. 2, an exemplary external loudspeaker system comprising an external loudspeaker apparatus 20 and a further external loudspeaker apparatus 30 is shown operating according to some embodiments.

The external loudspeaker apparatus 20 is interfaced with the further external loudspeaker apparatus 30 via the further interface cable 312. It is understood that the further interface cable 312 can in some embodiments be the same type of interface cable as the interface cable 212 shown in FIG. 1. In some such embodiments the further interface cable 312 can be releasable and comprises suitable terminating connectors or plugs at each end of the further interface cable 312. In some embodiments, the second interface cable 312 can be arranged as an extension of at least one of the connector sockets of the external loudspeaker apparatus 20 or the further external loudspeaker apparatus 30 and such in these embodiment be fixed to either or both the external loudspeaker systems 20, 30.

In such embodiments as shown in FIG. 1 or 2, the audio signal provided by the mobile phone 10 can be configured by the external loudspeaker apparatus 20 to provide stereo playback where the mobile phone 10 provides the stereo audio signal to the external loudspeaker apparatus 20, which outputs a first channel of the stereo audio signal and the further external loudspeaker apparatus 30 is connected and outputs a second channel of the stereo audio signal.

It is understood that the further external loudspeaker apparatus 30 can in some embodiments be unplugged and/or unpowered which would cause the external loudspeaker apparatus 20 to once again downmix the received audio signal to provide a monophonic playback experience. It is furthermore understood that the audio signal provided by the mobile phone 10 can be suitably configured relative to a number of external loudspeaker apparatus such that more than two of the external loudspeaker apparatus 20, 30 can be connected together to provide multi-channel audio capabilities. For example as shown in FIG. 2 the connections may be a 'daisy chain' of connections. However in some other embodiments any suitable configuration of connections can be implemented to provide the ability to pass audio signals and/or power between the plurality of external loudspeaker apparatus.

Figure 3:
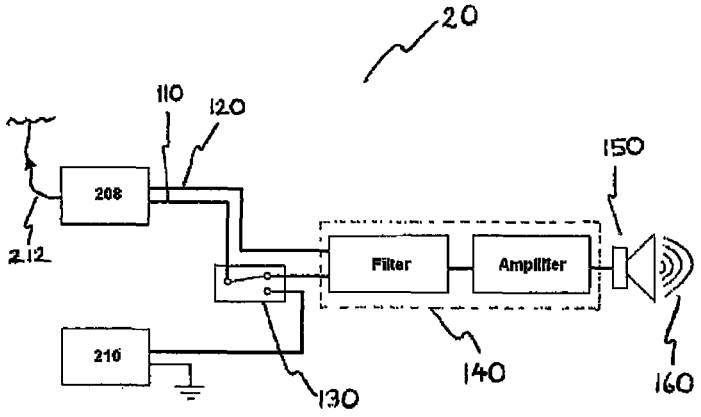
FIG. 3 shows schematically the apparatus in some embodiments.

In FIG. 3, a schematic block diagram of an exemplary external loudspeaker apparatus 20 or apparatus is shown in further detail. Where the same features as shown in FIGS. 1 and 2 are described the same reference labels are used. In the following examples only the audio connections from the connector socket, further connector socket and components of the external audio loudspeaker are shown, however as described above in some embodiments power may be also routed between devices in a similar manner to that described hereafter.

In some embodiments the external loudspeaker apparatus further comprises a first audio channel input connector 120 and a second audio channel input connector 110. The first audio channel input connector 120 is configured in some embodiments to connect the connector socket 208 to a controller 140 such that at least a first audio channel signal can be passed or routed from the connector socket to the controller 140. The second audio channel input connector 110 is configured in some embodiments to connect the connector socket 208 to a common node of at least one switch 130 such that at least a second audio channel signal can be passed or routed from the connector socket 108 to the common node of the at least one switch 130.

The external loudspeaker system 20 in some embodiments comprises at least one switch 130 which is configured to be suitable for connecting the connector socket 208 to the second connector socket 210. The at least one switch 130 comprises a common node which as described above is connected in some embodiments to the second audio channel input connector 110 and configured to receive at least audio signals for at least one channel. The at least one switch 130 can in some embodiments further comprise a first pole node which is configured to be connected to the controller 140 by a second controller 140 input. The at least one switch 130 can in some embodiments further comprise a second pole node which is configured to be connected by a connector to the further connector socket 210. The at least one switch 130 is configured to be operable in a first mode to electrically controls the routing of the second audio channel to the controller 140 and in a second mode to electrically route the second audio channel to the further connector socket 210.

In some alternative embodiments, the at least one switch 130 can be configured to connect 'unconnected' pole nodes to ground rather than leaving the circuit open.

The at least one switch is in some embodiments configured to route or switch more than a single audio signal. For example in some embodiments the switch is configured to route multiple audio signals and/or power connections to power further external audio loudspeaker apparatus.

In some embodiments the external loudspeaker apparatus 20 further comprises a controller 140.

The controller 140 is in some embodiments configured to passively determine the presence of at least one further external loudspeaker apparatus and to furthermore control the at least one switch 130 depending on the result of the determination. For example the insertion of an interface cable between the at least one further connector socket 210 of the external loudspeaker apparatus and the at least one connector 208 of the at least one further external loudspeaker apparatus can cause a signal to pass from the further external loudspeaker apparatus to the external loudspeaker apparatus to instruct the controller to control the switch.

In some embodiments the controller 140 is configured to actively monitor the at least one connector socket 208 and the at least one further connector socket 210 for the presence of the insertion of an interface cable and presence of mobile phone (or other external loudspeaker apparatus) configured to supply at least one channel audio signal and/or the presence of at least one external loudspeaker apparatus configured to receive at least one channel audio signal.

For example in some embodiments the controller 140 monitors the at least one connector socket 208 and the at least one further connector socket 210 to determine whether a plug has been inserted. In such embodiments the cable/connection used for the connection is configured in such a way that the insertion of the plug is detected by the controller and automatically routes the audio signal or signals to the further external loudspeaker apparatus.

For example the controller 140 can be configured to determine that when a plug is inserted into the at least one connector socket 208 and is providing a multi-channel audio input and that furthermore a plug is inserted into the at least one further connector socket 210 to be connected to at least one further external loudspeaker apparatus the at least one switch is to be operated in the second mode whereby the second channel audio signal is routed from the at least one connector socket 208 to the at least one further connector socket 210.

Whereas in some embodiments the controller 140 can be configured to determine that when a plug is inserted into the at least one connector socket 208 and is providing a multi-channel audio input and that furthermore there is no plug inserted into the at least one further connector socket 210 and thus no further external loudspeaker apparatus the at least one switch is to be operated in the first mode whereby the second channel audio signal is routed from the at least one connector socket 208 to controller 140 to be input to the filter 141.

The controller 140 can in some embodiments monitor the insertion of plug into sockets using a physical connection detector. In some further embodiments the controller 140 can in some embodiments determine whether connections and the type of connection by exchange of signalling control data, such as handshaking protocols between the mobile phone 10 and the external loudspeaker apparatus 10 when the two are connected together.

In some further embodiments the monitoring can further comprise determining the type of connection implemented by a plug inserted into either the at least one connector socket 208 and the at least one further connector socket 210. For example in some embodiments the monitoring could detect the difference between an audio connector and a power and audio connector.

In some embodiments the controller 140 can be configured to determine whether the at least one audio signal input via the connector plug 208 comprises a single or multi-channel audio signal. In such embodiments when the controller 140 determines a single channel audio signal input the determination of the presence or absence of at least one further external audio loudspeaker can be halted.

The controller 140 can furthermore in some embodiments comprise further modules or components to process the audio signals from at least the first audio channel and in some embodiments the first audio channel and the second audio channel. For example as shown in FIG. 3 in some embodiments the controller 140 comprises a filter 141 configured to receive inputs from the first audio channel input connector 120 and from the first pole node of the at least one switch 130. The filter 141 in some embodiments is configured to sum the audio signal from the first audio channel input connector 120 and the audio signal from the first pole node of the at least one switch 130 when the controller 140 determines that the only loudspeaker module being employed is the external loudspeaker apparatus 20 loudspeaker module 150. In some embodiments the filter 141 can band limit the audio signal or signals that may be a multi-channel audio signal. The filter 141 in some embodiments can be configured to filter the audio signal by suitably shaping at least one frequency component of the audio signal or signals. In some embodiments the full frequency spectrum of the audio signal or signals are suitably processed by the filter. In some embodiments, the filter 141 can be configured to attenuate some frequency components and enhance other frequency components of the audio signal or audio signals. In some embodiments the filter 141 can be an equalization filter. In such a manner the filter 141 can suitably filter the audio signal and be configured to operate as any known filter configuration, for example as a band-pass filter, a low-pass filter, a high-pass filter, or any general equalization filter.

In some further embodiments of the invention, the filter 141 can comprise more than one sub-filter which is a suitably designed filter-bank, for example a filter bank in the form of plural band-pass filters wherein the bandwidth and centre frequencies of each filter of the filter-bank may be suitably designed. The filter-bank in such embodiments can be a specially designed auditory filter-bank based on psychoacoustics modelling relative to human hearing mechanism. The filter 141 in some embodiments can be configured to filter the audio signal to enable the acoustic signal provided by the external loudspeaker system in response to the filtered audio signal to fulfil certain criteria. For example the filter 141 in some embodiments can be a filter with a flat pass-band in some use cases (these use cases can be for example ringtone playback use) so that at least one acoustic resonance or more may be generated so that user can hear a loud enough audible signal. The filter 141 can in such embodiments enhance or attenuate certain frequencies to provide an improved sound quality for the user such as music signal playback or speech call. The filter 141 furthermore in some embodiments can assist the production a desired frequency response to the ear and thus improve the perceived audio quality. In some embodiments, the filter 141 can produce a desired frequency response which may be unique and different for related use cases. For example, the filter 141 can in some embodiments produce a desired frequency response that may have at least one of a different bandwidth, level, or shape depending on the use case. Furthermore, the filter 141 in some embodiments can further consider or work in conjunction with other signal processing algorithms such as dynamic range controllers, noise cancellers, stereo widening and/or 3D binaural audio algorithms which are adaptively configured when two or more external loudspeaker systems are interfaced.

In some embodiments the controller can comprise an ECI or Enhancement Control Interface and particularly in some embodiments an ECI designed for Nokia AV-connectors. ECI enables accessory detection wherein accessory specific specifications such as signal processing algorithms, digital filter coefficients can be transferred from the accessory to the mobile phone so that uplink and downlink audio chains can be updated for each accessory. In some embodiments this can be implemented by flags in software of the external loudspeaker apparatus that are recognised by the mobile phone software. If a third party external loudspeaker apparatus is connected to the mobile phone, the mobile phone recognises the external loudspeaker apparatus as a third party device and configures the mobile phone audio system with default settings, for example a flat equalizer response and nominal gain levels. However if a recognised external loudspeaker apparatus is detected or determined to be connected by determining specific software settings for all AV accessories design and assign signal processing coefficients including DRCs (dynamic range controls), equalizers, gains, noise cancellers can be set according to the loudspeaker apparatus.

In some embodiments the controller 140 can further comprise an amplifier 143 configured to receive the output of the filter 141 and generate a suitably amplified signal to be passed to the loudspeaker module.

In some embodiments the external loudspeaker apparatus 20 comprises a loudspeaker module 150 configured to transform the electrical audio signal into an acoustic signal 160. It is understood that the acoustic signal 160 is a monophonic sound reproduction when only one external loudspeaker apparatus 20 is interfaced with the mobile phone 10 (and where the mobile phone itself does not implement the functionality of the external loudspeaker apparatus 20). Furthermore the acoustic signal 160 is a sound reproduction of one channel of the multi-channel audio signal when the number of external loudspeaker apparatus interfaced with the mobile phone is equal to the number of audio channels.

Figure 4:
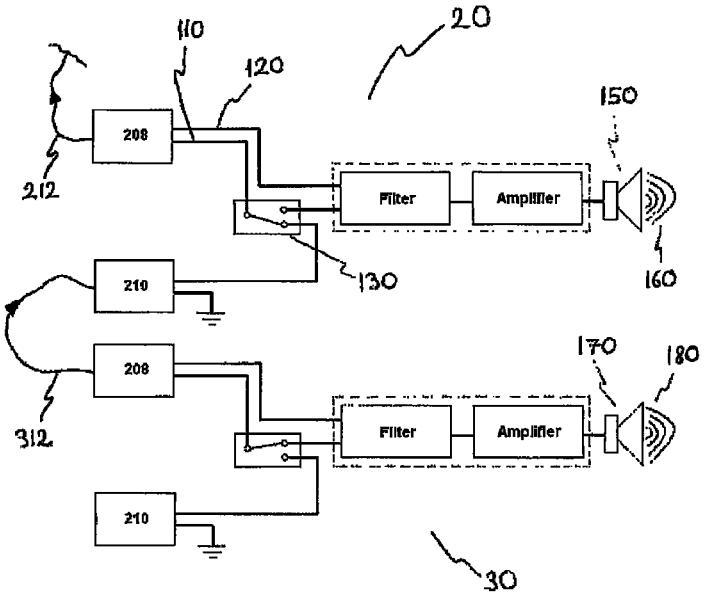
FIG. 4 shows schematically the apparatus shown in FIG. 3 in further detail.

As shown in FIGS. 3 and 4 are the examples where there is one external loudspeaker apparatus 20 and where there are two external loudspeaker apparatus 20, 30. As described above, with respect to FIG. 3, the first external loudspeaker apparatus 20 controller 140 on determining no further connection is configured to route the second audio channel input signal to the controller to be mixed with the first channel audio signal and output by the loudspeaker module 150 as a monophonic mix of the audio signals.

Whereas as shown in FIG. 4, the first external loudspeaker apparatus 20 controller 140, on determining a further interface cable or connection 312 to a second external loudspeaker apparatus 30 suitable for outputting at least one audio channel, is configured to route the second audio channel input signal to the further audio connector 210 to be passed to the second external loudspeaker apparatus 30.

The second external loudspeaker apparatus 30 can be configured furthermore in some embodiments to determine that the input signal is a single channel, or where the input signal is not a single channel to determine the absence of a further external loudspeaker apparatus connected to the second external loudspeaker apparatus 30 and so control the at least one switch to route the inputs to the second external loudspeaker controller. In other words the presence of the second external loudspeaker apparatus 30 is detected the second channel audio signal is provided to the second loudspeaker module 170 which generates the acoustic signal 180. The user can therefore experience a stereo listening experience when the audio signal is a stereo signal with a first and second audio channel.

Thus in such embodiments as there may be significant differences between the first and second channel audio signals of said stereo signals, for example, there may be differences in amplitude, phase and/or time delay between the first and second channel audio signals. Furthermore, there may be spectral or temporal differences that may help user to perceive a feeling of stereo widening or 3D audio effect. The embodiments of the application therefore provide the user the possibility to listen to stereo signals without diminishing stereo effects. In addition, the embodiments of the application provide the user the monophonic listening experience when the mobile phone 10 is interfaced with only one external loudspeaker system.

Several variations of the embodiments described above are possible. For example, the external loudspeaker apparatus 20, 30 controller 140 can comprise additional modules or components such as a processor executing various signal processing algorithms such as an equaliser, a dynamic range controller, an echo and/or noise canceller, transducer protection algorithms etc. The signal processing algorithms in some embodiments can comprise configuring settings for generating suitable audio signals to the loudspeaker modules. The external loudspeaker system in some embodiments can further comprise a memory for retrieval by the processor whenever needed. In some embodiments, the settings are adaptively generated or configured to be suitable for dedicated use cases. The memory in some embodiments further provides a section for storing data, for example data that has been processed in accordance with the embodiments.

The external loudspeaker apparatus can in some embodiments comprise two or more loudspeaker modules together with a suitable cross-over circuitry. The external loudspeaker apparatus can in some embodiments further comprise a mute functionality that mutes the second and/or more external loudspeaker system. The external loudspeaker apparatus 20 can enable a user to input commands, for example via a keypad and/or a touch interface. Furthermore in some embodiments the external loudspeaker apparatus 20 can be configured to accept commands or route commands to further external loudspeaker apparatus from the mobile phone 10 or other user equipment.

The external loudspeaker apparatus 20 in some embodiments can further comprise a display. The processor of the external loudspeaker apparatus 20 or the mobile phone 10 in some embodiments can generate image data to inform the user of playback operations and/or display a series of options from which the user can select using the user interface employed on the external loudspeaker apparatus 20 or the mobile phone 10. For example in some embodiments the user can enter spatial effects or an equalizer setting for audio signals to set a custom playback characteristic which may be modified depending on which loudspeaker module or external loudspeaker apparatus is used. In some embodiments the user interface can be in the form of a touch interface can be implemented as part of the display in the form of a touch screen user interface. While the above described embodiments of the invention are described, the skilled person in this art will recognise modifications of structure, arrangement, composition and the like which do not part from the true scope of the invention.

In some of the above embodiments the interface between the sound generating device 20 and the mobile phone 10 is provided using the interface cable 212 and further interface cable 312. In such embodiments it is understood that the interface cable 212, further interface cable 312 are wired connections. Alternatively in other embodiments the interface may be provided via any suitable type of connection such as any suitable wireless connection. In such embodiments the connectors 208 and further connectors 210 can be considered to be wireless communication ports or antennas capable of passing wireless data. In some embodiments the wireless connection can be for example a Bluetooth (BT) connection whereby the connectors and further connectors are Bluetooth modules, a wireless communication network such as WiFi, Wireless Local Area Network (WLAN) connection, IEEE 802.11 or IEEE 802.11 derived connection, a cellular communications network connection (such as universal mobile telecommunications system or UMTS connection), a personal area network (PAN) connection, or Infra Red data (IrDA). In these example embodiments, the multichannel audio signal is suitably configured when the mobile phone is wirelessly interfaced with the external loudspeaker apparatus.

Although the above examples have been shown in a manner whereby the external loudspeaker apparatus receives either two or one audio channel signals and determine whether to route one of the audio channel signals to a further loudspeaker apparatus on determination of the further loudspeaker apparatus presence it would be understood that in some embodiments multiple 'daisy chaining' operations could occur whereby the connector socket, further connector socket is configured to handle more than two channel audio data and the switch is configured to switch more than one channel audio data. In such embodiments as described above one of the more than two channel audio channels is passed to the controller, and the other channels are passed to the switch. The switch in such embodiments can be further configured to route the remainder of the channels either to a further external loudspeaker apparatus via the further connector socket when the controller determines a further external loudspeaker apparatus or to the controller to mix all of the channels and output the mix via the loudspeaker module of the external loudspeaker apparatus.

In such a manner some embodiments of the application can process multi-channel audio as 5.1, 7.1 and other channel audio formats using external loudspeaker apparatus.

In some embodiments the connector/cables can furthermore be used by the mobile phone or other user equipment as an antenna so to improve the mobile phone or other user equipment's capability to receive or transmit radio frequency signals. For example the connection between the mobile phone and the external loudspeaker apparatus could in some embodiments be used by the mobile phone as a Frequency Modulation (FM) antenna significantly improving the mobile phone's reception as well as then being capable of passing at least one audio channel of the received FM signal to the external loudspeaker apparatus.

Furthermore although the connector socket and further connector socket are shown as being configured to accept a single connection (for example a single plug) in some embodiments the connector socket and further connector socket can be configured to accept multiple connections (for example multiple connections each connected to a further apparatus connector socket). In such embodiments the external loudspeakers can be configured to operate in such a manner that the controller determines the presence of further external loudspeaker apparatus and controls a switch associated with each further connector connection such that the controller can route an audio channel signal to an external loudspeaker apparatus via one of the sub-connectors and therefore without requiring the audio signal to pass through a third external loudspeaker apparatus first.

In some embodiments the mobile phone 10 can comprise an 'external loudspeaker apparatus' in the form of an integrated handsfree loudspeaker module. In these embodiments the mobile phone 10 determines the presence of further external loudspeaker apparatus, which can in some embodiments be external loudspeaker apparatus as described with respect to FIGS. 1 to 4, or in some further embodiment comprise further mobile phones and the further mobile phones integrated handsfree loudspeaker module.

It is understood that both the mobile phone and the external loudspeaker apparatus can comprise in some embodiments a suitably configured transceiver and receiver that enables communication with the external loudspeaker system, for example via cellular or mobile phone gateway servers such as Node B or base transceiver stations (BTS) and a wireless communication network, or short range wireless communications to the microphone array or EWS (ear worn loudspeakers) where they are located remotely from the apparatus. In some embodiments the transceiver is operable to transmit and/or receive low power radio frequency signals such as Bluetooth, Zigbee, Bluetooth low energy (also known as Wibree or BT LE), or other suitable modulation/protocols operating in the unlicensed 2.4 GHz band. It should be understood that the external loudspeaker apparatus can therefore comprise additional features for a wireless connection that are not illustrated.

In some embodiments the external loudspeaker apparatus can comprise at least one sensor capable of determining the presence or recognising the interface of other external loudspeaker apparatus. In some alternative embodiments, the sensor can be employed in the mobile phone so that the audio signal is suitably routed relative to a number of the external loudspeaker apparatus. In such embodiments when there is only one external loudspeaker apparatus determined or discovered the multi-channel audio signal such as a stereo signal can be summed within the mobile phone for a monophonic playback experience. In some embodiments the mobile phone 10 can when the sensor determines a second external loudspeaker apparatus pass the first audio channel signal to the first external loudspeaker apparatus and pass he second audio channel signal to the second external loudspeaker apparatus to suitable configure the playback of said stereo signal. In such embodiments the user can therefore experience a stereo listening experience using a wireless interface when the audio signal is a stereo signal. In such embodiments the user can also experience a monophonic listening experience when the mobile phone is wirelessly interfaced with one external loudspeaker system. It is understood that the user can in some embodiments configure an external loudspeaker apparatus wirelessly for a monophonic playback experience and the audio signal provided by the mobile phone can be suitably configured relative to a number of external loudspeaker apparatus.

Thus in summary there is a method comprising: routing a first audio signal to a local loudspeaker apparatus; routing at least one further audio signal, wherein in a first mode of operation routing comprises routing the at least one further audio signal to at least one remote loudspeaker apparatus dependent on determining the presence of at least one remote loudspeaker apparatus; and in a second mode of operation routing comprises routing the at least one further audio signal to the local loudspeaker apparatus.

In some embodiments where the audio signal is provided by a mobile telephone the audio signal can represent a speech signal which is part of a telephone conversation.

In some embodiments the controller can be configured by or be a computer program or code operating on a processor and optionally stored in a memory connected to the processor. The computer program or code can in some embodiments arrive at the external loudspeaker apparatus via any suitable delivery mechanism. The delivery mechanism may be, for example, a computer-readable storage medium, a computer program product, a memory device such as a flash memory, a portable device such as a mobile phone, a record medium such as a CD-ROM or DVD, an article of manufacture that tangibly embodies the computer program. The delivery mechanism may be a signal configured to reliably transfer the computer program. The external loudspeaker system may propagate or transmit the computer program as a computer data signal to other external devices such as other external loudspeakers systems. Although the memory is mentioned as a single component it may be implemented as one or more separate components some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (e.g. Von Neumann)/parallel architectures but also specialized circuits such as field-programmable gate arrays (FPGA), application specific integration circuits (ASIC), signal processing devices and other devices. References to computer program, instructions, code etc. should be understood to encompass software for a programmable processor or firmware such as, for example, the programmable content of a hardware device whether instructions for a processor, or configuration settings for a fixed-function device, gate array or programmable logic device.

Although embodiments of the present application have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavouring in the foregoing specification to draw attention to those features of the application believed to be of particular importance it should be understood that the Applicant claims protection in respect of any patentable feature or combination of features hereinbefore referred to and/or shown in the drawings whether or not particular emphasis has been placed thereon.

The embodiments described with reference to FIGS. 1 to 4 are particularly referred to external loudspeaker systems employed for sound reproduction for playback operations. According to alternative embodiments, said external loudspeaker systems may be configured by means of employing different loudspeaker configurations for sound reproduction so that other arrangements such as bass-reflex designs may be achievable. For example, each external loudspeaker system can reproduce a pre-defined frequency range. In some alternative embodiments, there may be multiple external loudspeaker systems that may be used for a variety of different playback operations such as a stereo design to provide a stereo widening or a 3D audio arrangement. It is understood that such example arrangements may be further configured to provide a monophonic playback experience. In alternative embodiments, there may be at least two external loudspeaker system but still operate as a monophonic playback.

Furthermore it should be realised that the foregoing embodiments should not be constructed as limiting. Other variations and modifications will be apparent to person skilled in the art upon reading the present application. The disclosure of the present application should be understood to include any novel features or any novel combination of features either explicitly or implicitly disclosed herein or any generalisation thereof and during the prosecution of the present application or of any application derived there from, new claims may be formulated to cover any such features and/or combination of such features.

Although it is not explicitly shown in FIGS. 1 to 4, the external loudspeaker system may comprise other analogue and/or digital components configured to drive the loudspeaker module. The external loudspeaker system thus in these embodiments may further comprise a digital signal processing (DSP) component. The external loudspeaker system in same or other embodiments may comprise a microprocessor or processor configured to control and carry out the playback operations. In some embodiments the external loudspeaker system can comprise a battery configured to power the electrical components of the external loudspeaker system, such as for example the DSP component and processor. In some embodiments the analogue and digital components configured to drive the loudspeaker module may be in communication with the DSP component and with the microprocessor. In such embodiments the DSP and/or the microprocessor can control the analogue and digital components configured to drive the loudspeaker module to provide driving signals to the loudspeaker module. In other embodiments the DSP component and/or the microprocessor may adjust signals fed to the loudspeaker module, for example by providing an at least one of: an equalizer function, a gain control, a dynamic range controller, an excessive diaphragm movement prevention control. The operation of the DSP module and/or the microprocessor can in some embodiments improve performance of audio playback. Other alternative configurations are conceivable and are within the scope of this disclosure.

It shall be appreciated that the term external loudspeaker system or user equipment is intended to cover any suitable type of equipment with a loudspeaker configuration, such as mp3 players, radio receivers and transceivers, and portable data processing devices or portable web browsers with audio capabilities. Furthermore, it will be understood that the term acoustic sound channels is intended to cover sound outlets, inlets, channels and cavities, and that such sound channels may be formed integrally with the transducer and/or with the connectors, or as part of the mechanical integration of the transducer and/or the connector with the device.

As used in this application, the term 'circuitry' refers to all of the following:

(a) hardware-only circuit implementations (such as implementations in only analog and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including any claims. As a further example, as used in this application, the term 'circuitry' would also cover an implementation of merely a processor (or multiple processors) or portion of a processor and its (or their) accompanying software and/or firmware. The term 'circuitry' would also cover, for example and if applicable to the particular claim element, a baseband integrated circuit or applications processor integrated circuit for a mobile phone or similar integrated circuit in server, a cellular network device, or other network device.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. A method comprising:

detecting, by an audio signal source device, the presence of at least one external loudspeaker apparatus;

controlling a multichannel audio signal by the audio signal source device in such a way that if the at least one external loudspeaker apparatus is detected as a single audio output source, combining audio signals of the multichannel audio signal at the audio signal source device so as to output a summed audio signal as a single audio signal from the at least one external loudspeaker apparatus; and when at least one further external loudspeaker apparatus is detected by the audio signal source device as a further audio output source, routing a respective audio signal of the multichannel audio signal by the audio signal source device dependent on detection of the at least one further external loudspeaker apparatus connected as the further audio output source, wherein at least one of the audio signals of the multichannel audio signal is reproduced from the at least one external loudspeaker apparatus and the respective audio signal of the multichannel audio signal is routed to the at least one further external loudspeaker apparatus by the audio signal source device in order to reproduce the respective audio signal from the at least one further external loudspeaker apparatus.

2. The method as claimed in claim 1, further comprising controlling a switch that routes audio signals based on detection of the further external loudspeaker apparatus.

3. The method as claimed in claim 1, further comprising determining a connection between the at least one external loudspeaker apparatus and the at least one further external loudspeaker apparatus allowing the routing of the multichannel audio signal.

4. The method as claimed in claim 1, further comprising routing the multichannel audio signal using a router to route the summed audio signal to the at least one external loudspeaker apparatus and a switch for routing the respective audio signal of the multichannel audio signal to the at least one further external loudspeaker apparatus.

5. The method as claimed in claim 4, where the switch routes the multichannel audio signal to the at least one external loudspeaker apparatus and a further switch routes the respective audio signal of the multichannel audio signal from the at least one external loudspeaker apparatus to the at least one further external loudspeaker apparatus.

6. The method as claimed in claim 1, further comprising routing the multichannel audio signal to the at least one external loudspeaker apparatus wherein the at least one external loudspeaker outputs the at least one of the audio signals of the multichannel audio signal.

7. The method as claimed in claim 1, further comprising detecting the at least one external loudspeaker apparatus using a controller, processing the at least one of the audio signals of the multichannel audio signal by the controller in accordance with detecting the at least one external loudspeaker apparatus.

8. The method as claimed in claim 7, further comprising filtering the at least one of the audio signals received by a filter from at least one switch and sum the multichannel audio signal when only the at least one external loudspeaker apparatus is detected.

9. The method as claimed in claim 8, where filtering the at least one of the audio signals by the filter includes attenuating some frequency components and enhancing other frequency components.

10. The method as claimed in claim 8, where filtering the at least one of the audio signals by the filter includes producing a desired frequency response of a different bandwidth or shape.

11. The method as claimed in claim 1, where the at least one further external loudspeaker apparatus can detect additional audio signals and sum the respective audio signal with the additional audio signals for reproduction on the at least one further external loudspeaker apparatus unless at least one additional external loudspeaker apparatus is detected, then route any additional audio signal to such at least one additional external loudspeaker apparatus.

12. The method as claimed in claim 1, where the at least one of the audio signals of the multichannel audio signal is passed to a controller and remaining audio signals of the multichannel audio signal are passed to a switch, the switch routes the remaining audio signals of the multichannel audio signal to the at least one further external loudspeaker apparatus when detected, and when not detected the switch routes the remaining audio signals of the multichannel audio signal to the controller to be summed providing a summed audio signal to the at least one external loudspeaker apparatus.

13. The method as claimed in claim 1, further comprising:

applying at least one auditory filter bank to a multichannel audio signal, wherein the at least one auditory filter bank is based on a psychoacoustic model relative to human hearing.

14. The method as claimed in claim 13, where applying the at least one auditory filter bank further comprises:

filtering with a flat pass band to provide at least one acoustic resonance to produce an audible signal.

15. The method as claimed in claim 13, where applying the at least one auditory filter bank further comprises:

at least one of enhancing and attenuating particular frequencies to provide improved quality of musical signal playback.

16. The method as claimed in claim 13, where applying the at least one auditory filter bank further comprises:

applying the at least one auditory filter bank in conjunction with additional signal processing based on accessory specific specifications associated with the at least one external loudspeaker apparatus.

17. An apparatus comprising:

at least one processor; and at least one non-transitory memory including computer program code, the at least one memory and the computer program code configured to, with the at least one processor, cause the apparatus at least to perform:

detecting, by an audio signal source device, the presence of at least one external loudspeaker apparatus;

controlling a multichannel audio signal by the audio signal source device in such a way that if the at least one external loudspeaker apparatus is detected as a single audio output source, combining audio signals of the multichannel audio signal at the audio signal source device so as to output a summed audio signal as a single audio signal from the at least one external loudspeaker apparatus; and when at least one further external loudspeaker apparatus is detected by the audio signal source device as a further audio output source, routing a respective audio signal of the multichannel audio signal by the audio signal source device dependent on detection of the at least one further external loudspeaker apparatus connected as the further audio output source, wherein at least one of the audio signals of the multichannel audio signal is reproduced from the at least one external loudspeaker apparatus and the respective audio signal of the multichannel audio signal is routed to the at least one further external loudspeaker apparatus by the audio signal source device in order to reproduce the respective audio signal from the at least one further external loudspeaker apparatus.

18. The apparatus as claimed in claim 17, further comprising controlling a switch that routes audio signals based on detection of the at least one further external loudspeaker apparatus.

19. The apparatus as claimed in claim 17, further comprising determining a connection between the at least one external loudspeaker apparatus and the at least one further external loudspeaker allowing the routing of the multichannel audio signal.

20. The apparatus as claimed in claim 17, further comprising routing the multichannel audio signal using a router to route the summed audio signal to the at least one external loudspeaker apparatus and a switch for routing the respective audio signal of the multichannel audio signal to the at least one further external loudspeaker apparatus.

21. The apparatus as claimed in claim 17, where the switch routes the multichannel audio signal to the at least one external loudspeaker apparatus and a further switch routes the respective audio signal from the at least one external loudspeaker apparatus to the at least one further external loudspeaker apparatus.

22. The apparatus as claimed in claim 17, further comprising routing the multichannel audio signal to the at least one external loudspeaker apparatus wherein the at least one external loudspeaker apparatus outputs the at least one of the audio signals of the multichannel audio signal.

23. The apparatus as claimed in claim 17, where the external loudspeaker apparatus can detect additional audio signals and sum the audio signal with the additional audio signals for reproduction on the external loudspeaker apparatus unless a further external loudspeaker apparatus is detected, then route any additional audio signal to such further external loudspeaker apparatus.

24. The apparatus as claimed in claim 17, where the audio signal is passed to a controller and remaining multichannel audio signals are passed to a switch, the switch routes the remainder of the audio signals to further external loudspeaker apparatus when detected, and when not detected the switch routes the remaining audio signals to the controller to be summed providing a summed audio signal to the external loudspeaker apparatus.

* * * * *